US006860315B2

(12) United States Patent
Williamson

(10) Patent No.: US 6,860,315 B2
(45) Date of Patent: Mar. 1, 2005

(54) GREEN SAND CASTING METHOD AND APPARATUS

(75) Inventor: Warren G. Williamson, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/916,000

(22) Filed: Jul. 26, 2001

(65) Prior Publication Data

US 2003/0019603 A1 Jan. 30, 2003

(51) Int. Cl.[7] ..... B22D 25/02; B22D 33/04; B22C 9/02; B22C 9/08; B22C 9/10

(52) U.S. Cl. ..... 164/133; 164/134; 164/137; 164/358; 164/363; 164/369

(58) Field of Search ..... 164/57.1, 133, 164/28, 30, 520, 137, 339, 340, 349, 358, 362, 364, 365, 366, 369, 363, 134, 135, 136, 342

(56) References Cited

U.S. PATENT DOCUMENTS

| | | | | |
|---|---|---|---|---|
| 728,011 A | | 5/1903 | Reed | 164/364 |
| 1,003,709 A | | 9/1911 | Cordingly | 164/356 |
| 1,502,861 A | * | 7/1924 | Meloche | 164/365 |
| 2,150,510 A | | 3/1939 | Jeune | 164/358 |
| 2,268,676 A | | 1/1942 | Shanley | 164/369 |
| 2,919,479 A | * | 1/1960 | Menningen | 164/361 |
| 3,554,271 A | | 1/1971 | Goss | 164/137 |
| 3,897,817 A | | 8/1975 | Nieman | 164/364 |
| 3,971,433 A | * | 7/1976 | Duchenne | 164/362 |
| 4,154,289 A | * | 5/1979 | Jeanneret | 164/358 |
| 4,352,390 A | | 10/1982 | Larson | 164/351 |
| 4,456,051 A | * | 6/1984 | Hukuhara | 164/131 |
| 4,742,863 A | | 5/1988 | Witt | 164/255 |
| 4,913,218 A | * | 4/1990 | Seidinger | 164/358 |
| 5,033,531 A | * | 7/1991 | Fisher et al. | 164/57.1 |
| 5,201,811 A | * | 4/1993 | Lebold et al. | 164/28 |
| 5,390,723 A | * | 2/1995 | Mohla et al. | 164/57.1 |
| 5,526,868 A | * | 6/1996 | Campbell et al. | 164/133 |
| 5,743,321 A | * | 4/1998 | Joern et al. | 164/44 |
| 5,887,646 A | * | 3/1999 | Evans et al. | 164/364 |
| 6,540,005 B1 | * | 4/2003 | Daussan et al. | 164/58.1 |

FOREIGN PATENT DOCUMENTS

| | | |
|---|---|---|
| DE | 922 299 | 1/1955 |
| JP | 56-26657 | 3/1981 |
| JP | 4-288943 | 10/1992 |
| SU | 698718 | 12/1979 |

* cited by examiner

*Primary Examiner*—Kevin P. Kerns
(74) *Attorney, Agent, or Firm*—Harness, Dickey & Pierce, P.L.C.

(57) ABSTRACT

An apparatus and method for casting metallic components is disclosed. The apparatus has a vertical parting line and a gate configuration which reduces defects within the cast components.

36 Claims, 8 Drawing Sheets

GREEN SAND CASTING METHOD AND APPARATUS

FIELD OF THE INVENTION

The present invention relates to a method and apparatus for casting metallic components, and more particularly to a casting apparatus and method using a vertical parting line which reduces the amount of impurities and imperfections in a complicated final cast product.

BACKGROUND OF THE INVENTION

Scroll elements have long been produced in iron base and other alloys using various forms of sand casting. Because, for most applications, these castings must subsequently be extensively machined to very precise tolerances and must be free of injurious defects, it is desirable to minimize casting tolerances and sand related quality problems such as scabs, inclusions and blow-holes. These considerations have tended to favor the application of premium casting methods such as shell molding and lost foam casting. Less costly casting methods, such as various green sand techniques have often been used, but typically with only modest success owing to considerations related to tolerances and quality. For green sand casting, tolerances for the most important casting features, such as the involute of a scroll component, can be improved through the use of shell, cold-box or similar cores and through careful attention to the design of core prints. Additionally, by locating the prints in the same side of the mold as the green sand cast features, tolerances can be further improved. Unfortunately, some sand related quality problems tend to remain. In the case of ordinary low cost horizontally parted molds, well known principles of design of the gating system (runners, gates, sprue bases, chokes, tails, etc.), can address the root cause of many of these quality problems with some success. In the case of very low cost vertically parted molds, as produced on a Disamatic mold making machine, even the most carefully designed conventional gating systems have been less successful in avoiding the generation of loose sand and sand related quality defects.

In sand casting a scroll component, the narrow and deep space of the involute vanes are especially susceptible to entrapping foreign material such as loose sand that might be carried along with the molten metal. The orientation of the involute is a factor in this susceptibility. Involutes that have a horizontal axis function as quite efficient traps. This horizontal involute orientation is generally applied in connection with lower cost vertically parted molds, the same parting line orientation which is prone to the generation of loose sand. Rather than attempting to rely on conventional gating and filter cores, a preferable approach is to apply a novel design to the gating system which will generate less loose sand. Expressed in general terms, with conventional gating in a vertically parted mold, it is believed that there are three causes for the generation of loose sand, high velocities, abrupt changes in direction and turbulence. This invention constitutes a remedy which can address these causes as appropriate.

SUMMARY OF THE INVENTION

It is the object of the present invention to overcome the quality limitations of green sand casting, including vertically parted molds, for the production of scroll elements and similar items requiring high casting accuracy and high quality. It is further an object of the current invention to produce green cast components absent of sand inclusions and blow-holes.

As such, the present invention has a vertically parted sand mold formed as impressions of first and second side patterns. Impression of at least one of the side patterns defines a pouring basin which communicates with a sprue. Additionally, the mold formed by one of the side patterns has a core; the core having an imprint surface and defining a gate or riser neck therein.

Further areas of applicability of the present invention will become apparent from the detailed description provided hereinafter. It should be understood that the detailed description and specific examples, while indicating the preferred embodiment of the invention, are intended for purposes of illustration only and are not intended to limited the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The description of the general structures of the illustrative scroll components is not intended as limiting. The skilled artisan will appreciate that the components depicted are shown schematically and that variations, modifications and improvements of such structural features are contemplated as within the scope of the present invention. Moreover, the present invention contemplates its usefulness in many different scroll structures, other than those shown.

Figure 1:
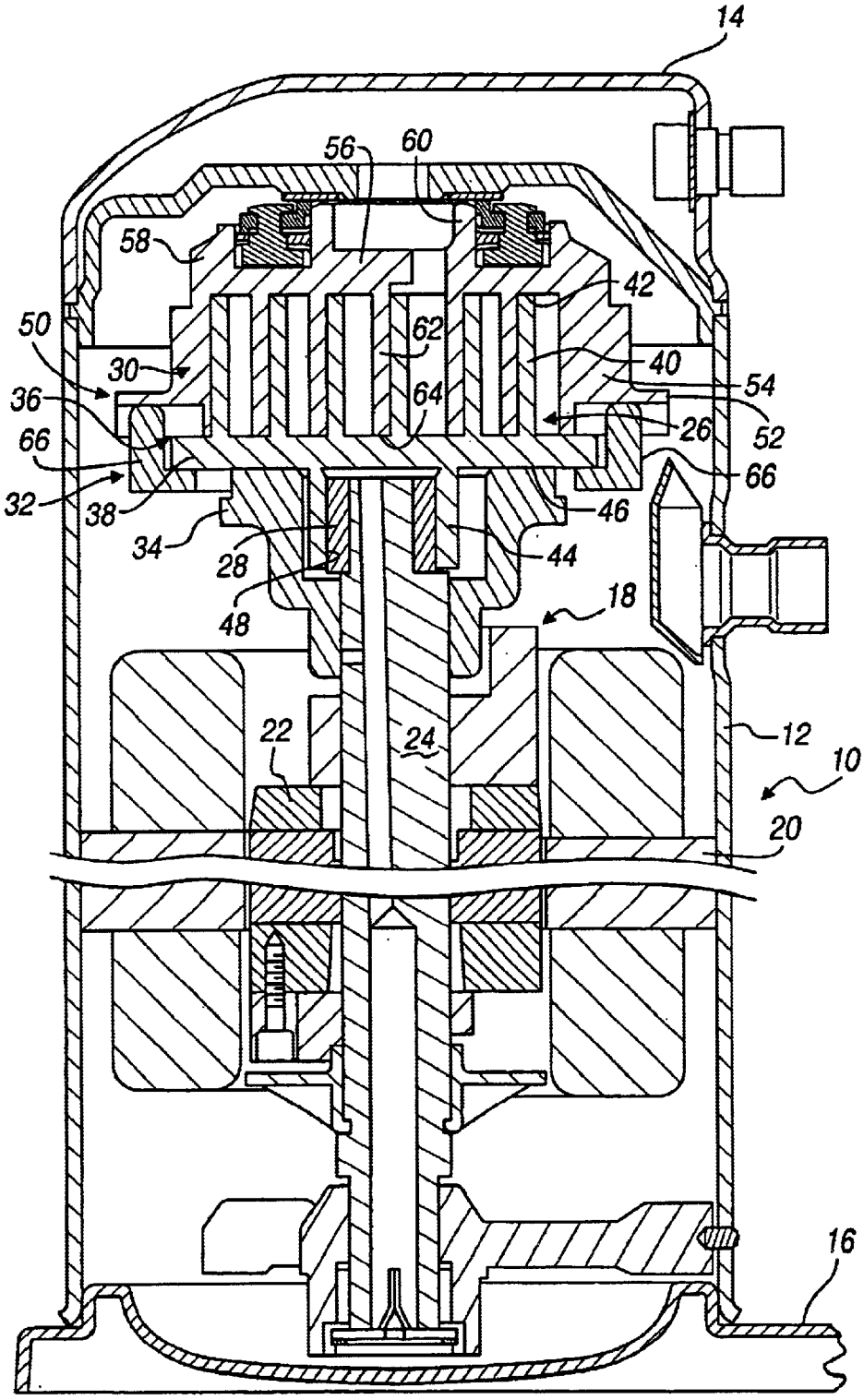
FIGS. 1 and 2 represent a scroll machine and components formed using the casting apparatus and method of the current invention.

The general structure of a scroll machine (e.g., without limitation, a scroll compressor) typically includes a crankshaft operative to drive (e.g., by way of a suitable motor) at least one of a pair of scroll members in relative orbital motion with respect to a second interleaved scroll member. FIG. 1 illustrates the general components of a typical scroll machine 10. There is shown in FIG. 1 a generally cylindrical hermetic shell 12 having a cap 14 at one end and a base 16 at the other. An electric motor 18, including a stator 20 and a rotor 22 connected to a crankshaft 24, drives the crankshaft 24. The crankshaft 24, in turn, is connected to a first scroll member 26. An unloader drive bushing 28 is disposed between the first scroll member 26 and the crankshaft 24. The first scroll 26 is interleaved with a second scroll member 30. An Oldham ring 32 is disposed between the first scroll member 26 and second scroll member 30 to prevent or limit relative rotation of the first scroll member 26 and the second scroll member 30. A main bearing housing 34 is disposed beneath and supports the first scroll member 26.

Figure 2:
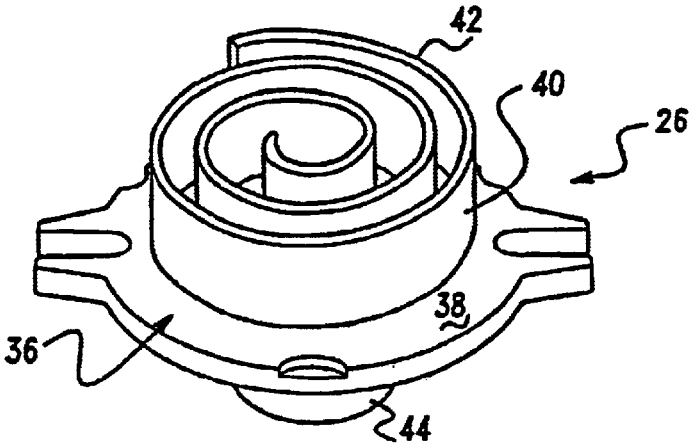

Referring to FIG. 1 and FIG. 2, there is shown an example of the first scroll member 26. The scroll member 26 has a base 36. The base 36 includes a plate 38 defining a surface from which a spiroidal vane 40 extends. The vane 40 terminates at a vane tip 42. A cylindrical hub 44 extends from a surface 46 in a direction away from the spiroidal vane 40. The cylindrical hub 44 has an axial bore 48 defined therein in which is rotatively disposed the unloader bushing 28 having an inner bore structurally defined to engage an end of the crankshaft 24 (such as, for instance, as disclosed in U.S. Pat. No. 4,767,293, hereby incorporated by reference).

FIG. 1 also depicts an example of a suitable second scroll member 30. The second scroll member 30 includes a base portion 50 having a first plate 52, a wall 54 depending from the first plate 52, and a second plate 56. A sealing flange 58 extends away from the second plate 56 about the periphery of the latter. A sealing collar 60 within the sealing flange 58 extends away from the second plate 56. A spiroidal vane 62 extends from a surface of the second plate 56 opposite the surface from which the sealing collar 60 originates. The vane 62 terminates at a vane tip 64.

The scroll compressor components can be employed in coacting combination with one another, as the skilled artisan will appreciate. Examples of representative U.S. Patents illustrating the operation of a scroll compressor and various embodiments and improvements of the same include, without limitation, U.S. Pat. Nos. 4,767,293 and 5,411,384, which are hereby expressly incorporated by reference.

Oldham couplings (such as ring 32) have taken various forms but generally incorporate two pairs of keys 66, with one pair engaging slots in the first scroll member and the other pair engaging either slots in the second scroll member or a stationary body or bearing housing. Of course, variations and improvements of the same exist as demonstrated in, for example (without limitation) U.S. Pat. No. 5,320,506, hereby expressly incorporated by reference.

The present invention involves a system and method for casting scroll machine components with fewer casting defects and improved tolerances. In one embodiment, the present invention contemplates the use of a particular gate system within the mold to reduce the amount of eroded molding materials. In another embodiment, the present invention contemplates the incorporation of the fusible plug into the gating system, either with or without the presence of added alloying materials. The incorporation of the fusible plug is particularly preferred for the scroll machine components which have large involute features, and are thus potentially more susceptible to the casting defects than other components. Specifically, the present invention finds particular utility for scroll machine parts, such as (without limitation) scroll members, unloading bushings, bearing housings, and devices which prevent or limit relative scroll rotation such as Oldham couplings.

Figure 3:
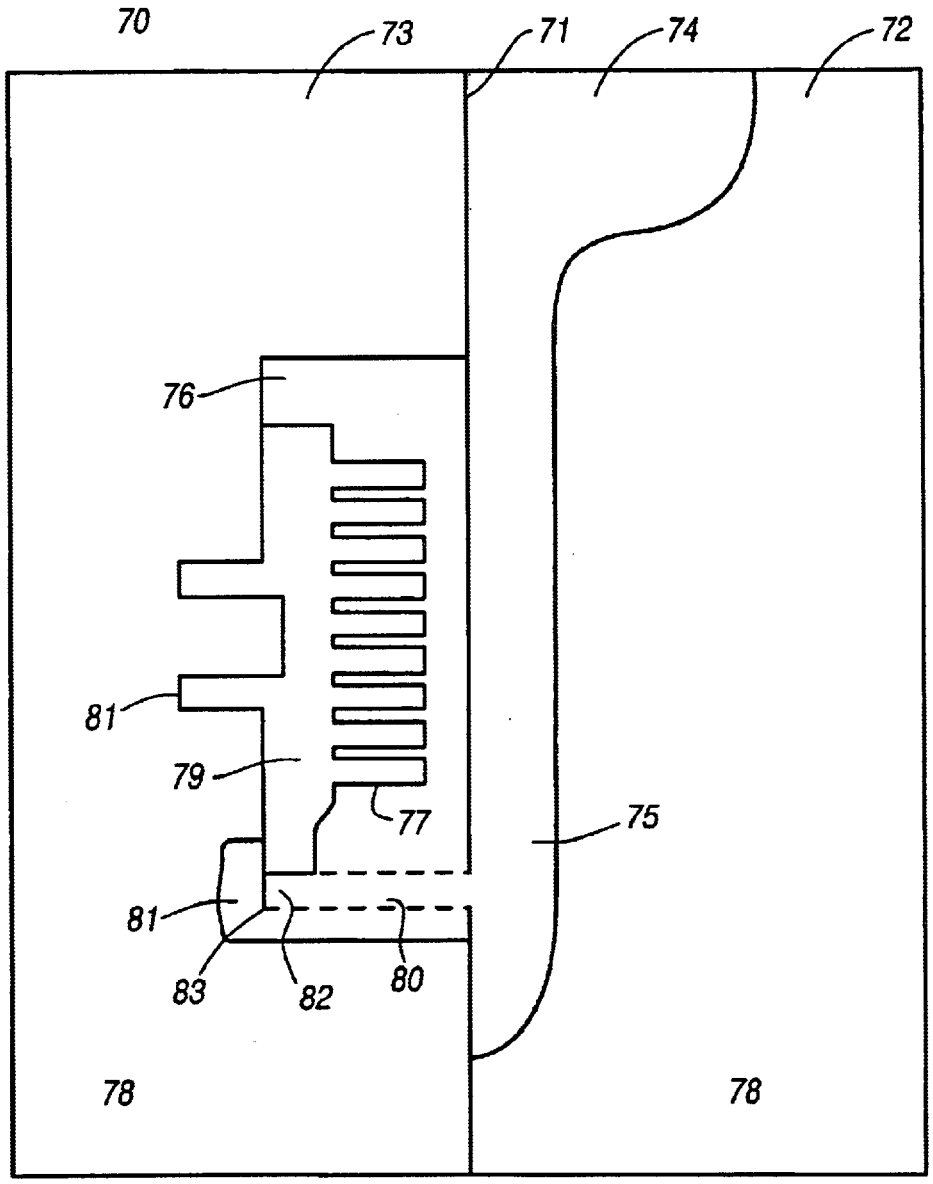
FIG. 3 represents the completed sand mold assembly of the current invention.

As such, FIG. 3 discloses a sand mold assembly 70 having a vertical parting line 71 and first 72 and second 73 side molds. The sand mold 70 is formed using green sand molding material 78, which is a molding material made of sand and clay as is known in the art. Additionally, the mold contains a core 76, which preferably contains the details of the particular cast components. At least one of the side molds defines a pouring basin 74 with which a sprue 75 communicates. The second side mold 73 has the core 76 incorporated therein. The core 76 has an imprint surface, which defines the involute characteristics of the cast component and also defines at least one gate 80 for the cavity 79 therein. It is preferred that the first side mold 72 define the sprue 75 and pouring basin 74, and the second side mold 73 has the cavity 79 defined therein. The skilled artisan will appreciate that two opposite faces of each side mold can include impressions of the first and second side patterns respectively. In this way, a continuous string of molds can be efficiently assembled.

The design of the side patterns for generating the sand mold 70 involves including the core print 77 in the same side of the sand mold 70, which includes the green sand portion 78 of the mold cavity 79. This arrangement allows for the elimination of the detrimental effects of registration errors between the side molds, known as mismatch. This is contrasted with more conventional practice in which one side mold features the core print and the other side mold forms some portion of the actual cavity. As best can be seen in FIG. 3, the first side mold 72 contains no features of the cast part, containing instead the pouring basin 74 and the sprue 75. This reduces the surface area of green sand molding material 78, which is exposed to high velocity molten metal.

The core 76, which is preferably formed in the shell or cold box process of a resin bonded sand, defines the gate 80 into the cavity 79. The gate 80 can take the form of a notch gate or a hole defined through core 76. In either instance, the core 76 preferably defines a resin bonded backsplash 81 which prevents the inflowing molten metal from impinging on a green sand molding material 78 at a location where the molten metal must change direction 82. The function of the backsplash 81 is to provide a surface of heat and erosion resistant core material on the downstream side 83 of the mold cavity gate 80 where the flow direction changes. Absent this feature, the flow direction change would more likely cause impingement erosion of the surface of the green sand molding material 78. This will significantly reduce the amount of molding material entering the cavity 79. It is preferred that the backsplash 81 be formed integrally with the core 76 containing the involute core print 77.

Figure 4:
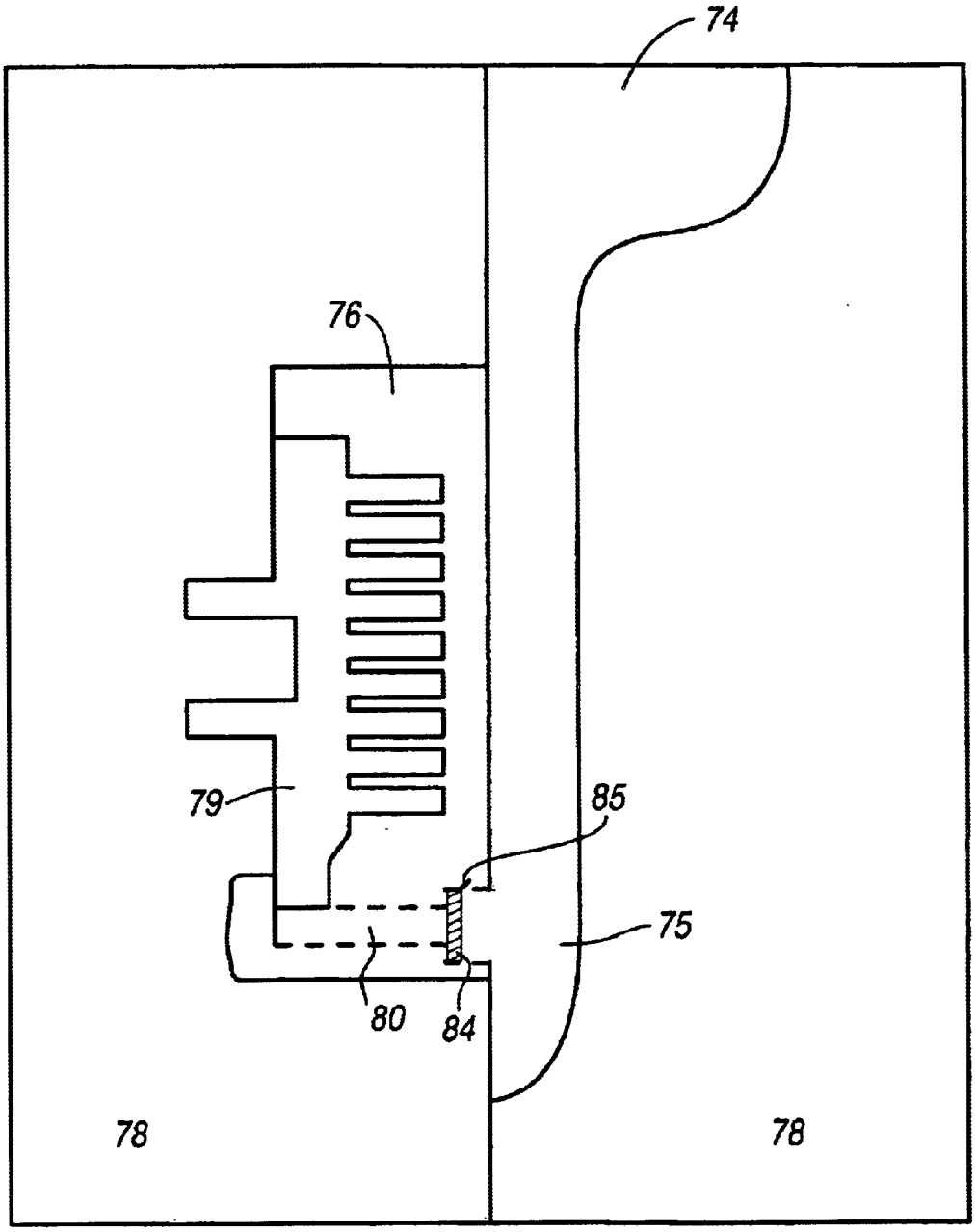
FIG. 4 presents an alternate embodiment of the current invention including a fusible plug.
Figure 5:
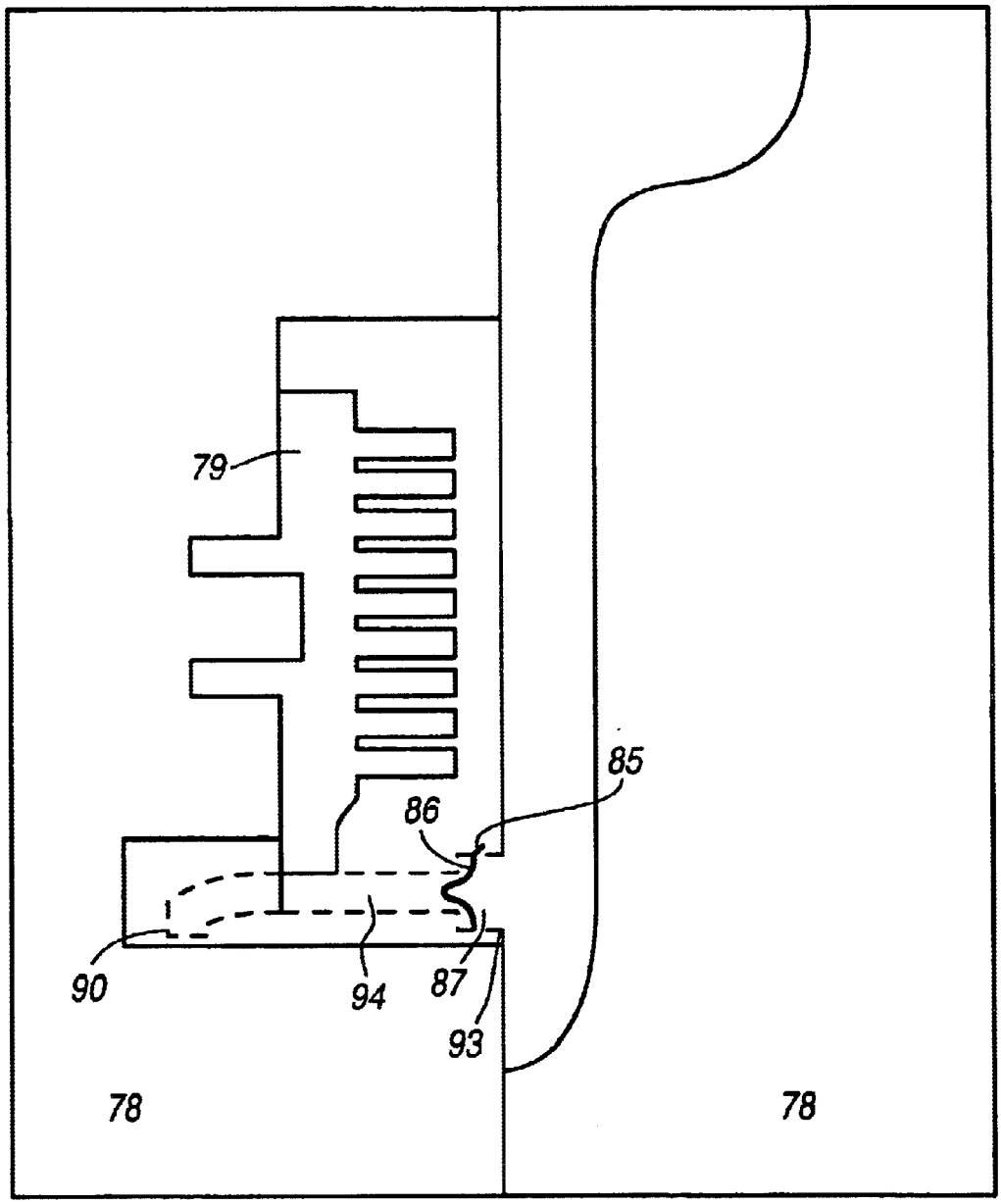
FIG. 5 represents an alternate embodiment of the current invention depicting an alternate configuration for the fusible plug member.

Although the gate 80 or gates can be a simple through hole in the core 76, under certain circumstances this may benefit from enhancement designed to control one source of turbulence. The turbulence arises from initiation of flow of molten metal through the gate 80 prior to complete filling of the gating system. As best seen in FIG. 4, whether the gate is an edge gate, a notch gate, or a hole defined through the core 76, the gate 80 can contain a fusible plug 84. The fusible plug 84 can be a steel disk inserted into the gate 80 of the core 76. Preferably, this fusible plug 84 can be fixedly coupled to the core 76 by means of attachment tabs 85 or ears on the fusible plug 84. Alternately, as shown in FIG. 5, the fusible plug 84 can be cup shaped 86. In any form, the fusible plug 84 functions to delay the onset of the influx the molten material into the cavity 79 until the sprue 75 and pouring basin 74 are filled with sufficient molten material to fill the cavity 79. The fusible plug 84 can alternatively be incorporated a riser neck should the mold design necessitate its use. The use of a fusible plug 84 significantly reduces the amount of turbulence caused by velocity changes of the molten metal and reduce the amount of erosion induced defect material within the final product.

There are several options to facilitate retention of the fusible plug 84. A core box slide can form a suitable slot 87 into which a fusible disc or square 84 will fit. Alternately, the cup shaped drawn fusible plug 86 can be formed to contact the inner surface of the gate 80. As shown, the optional "ears" 85 at the open end of the cup shaped drawn fusible plug 86 can be provided to function like barbs, aiding in retention of the cup shaped fusible plug 86 directly in a hole or notch gate 80 in the involute core print 77. Various glues and refractory cements can also be usable in retention of any form of fusible plug 84 or 86.

Equipped with at least one fusible plug 84, the sprue 75 can be completely filled prior to the onset of flow into the mold cavity or cavities. Generally, the fusible plug 84 is different from those which have long been used in connection with in-mold inoculation or conversion to ductile or compacted graphite, with those fusible plugs being set in a depression after the mold is closed. However, it is recognized that it may be useful to apply this older form of fusible plugs 84 in combination with the present invention either to take advantage of in-mold inoculation as well as to diminish vertical molten flow velocity.

If it is desired to apply a fusible plug 84 in the absence of an involute core 76, for example, with a large diameter short vane scroll which can be molded entirely in green sand casting material 78, the fusible plug 84 could be placed directly in the mold including by use of an automatic core setter.

The primary function of the fusible plug 84 is the control of loose sand entering the mold cavity 79, but an additional object or advantage is to eliminate shot type defects, which the first metal entering the mold cavity can sometimes form, especially with low pouring temperatures. This permits and facilitates the use of low pouring temperatures for reasons of microstructural control or energy savings without compromise of quality.

In circumstances where fusible plugs are not desired or where they are not sufficient to eliminate erosion induced contaminants from the initial portion of the molten metal, further enhancement to the present invention can be achieved by adding a "J" shaped fluid trap 90 to the sprue 75, gate 80, or runner. This allows the initial portion of the molten metal to be captured away from the cavity and not allowed to enter the mold cavity. FIG. 5 depicts the use of the J-shaped fluid trap 90 to capture the initial portion of the molten metal flowing toward the cavity 79. Generally, this initial molten material will contain the majority of the loose mold constituents.

Figure 6:
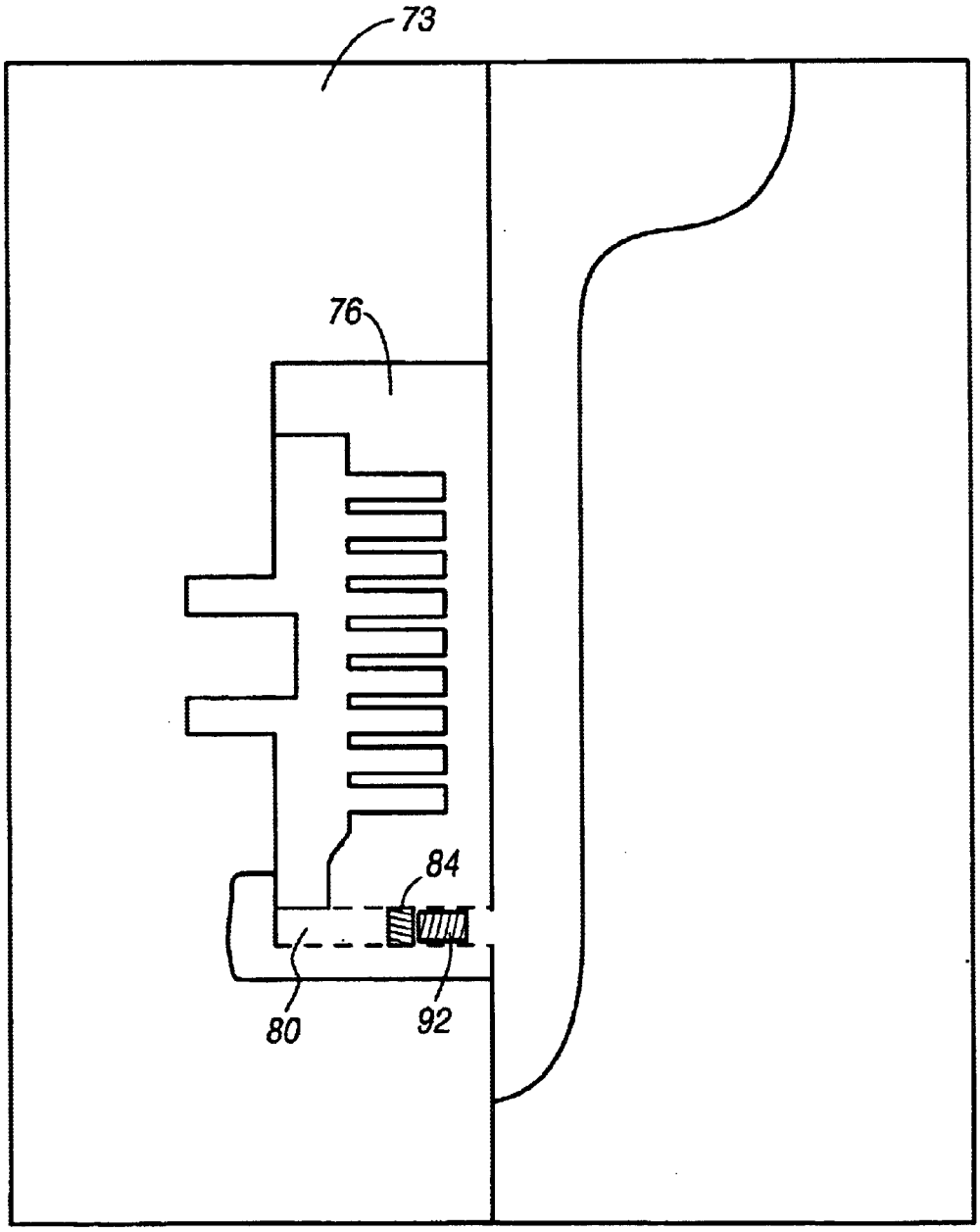
FIG. 6 represents an alternate embodiment of the current invention including a ceramic filter.

As best seen in FIG. 6, the apparatus of the current invention optionally can contain a filter element 92 within the gate 80 of the core 76. It is envisioned that this filter element 92 can be inserted into the gate 80 after the insertion of the core 76 into the first side pattern 72 of the pattern mold 70. It may also either be integrally formed in the core 76, or can be molded into the core 76, or alternatively may be inserted into the core 76 prior to the core's incorporation in the pattern mold 70.

As shown in FIGS. 5 and 6, the ceramic filter element 92 may be used to hold the fusible plug 84 into the gate 80. The gate 80 can also have a first diameter portion 93 for holding the ceramic filter element 92 and fusible plug 84 and a second diameter 94 for restricting the flow of the molten metal into the cavity. It is envisioned that the gate 80 and/or region can be designed to alter or control the flow of molten material into the cavity 79.

Figure 7:
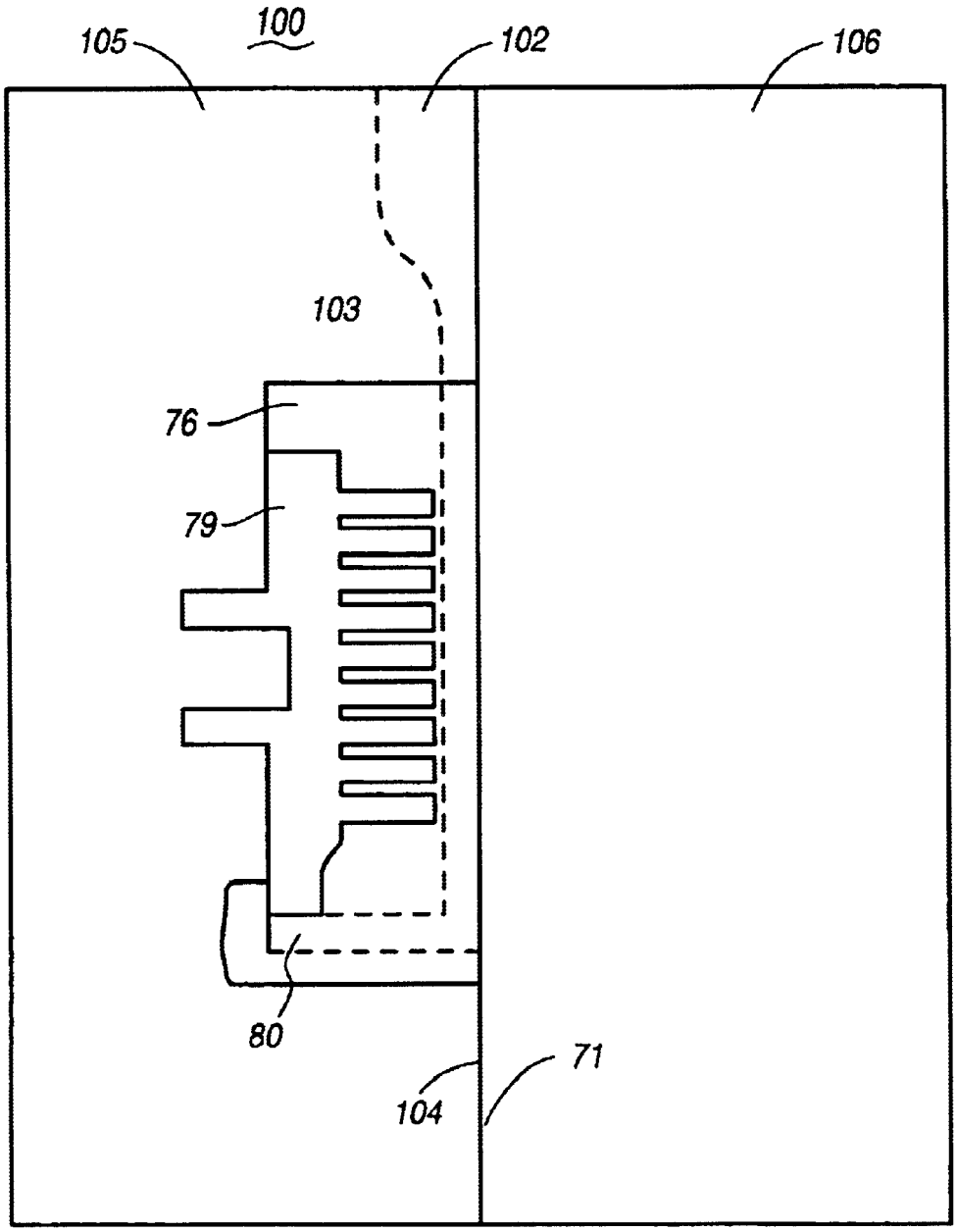
FIGS. 7 and 8 represent alternate configurations of the mold assembly of the current invention.
Figure 8:
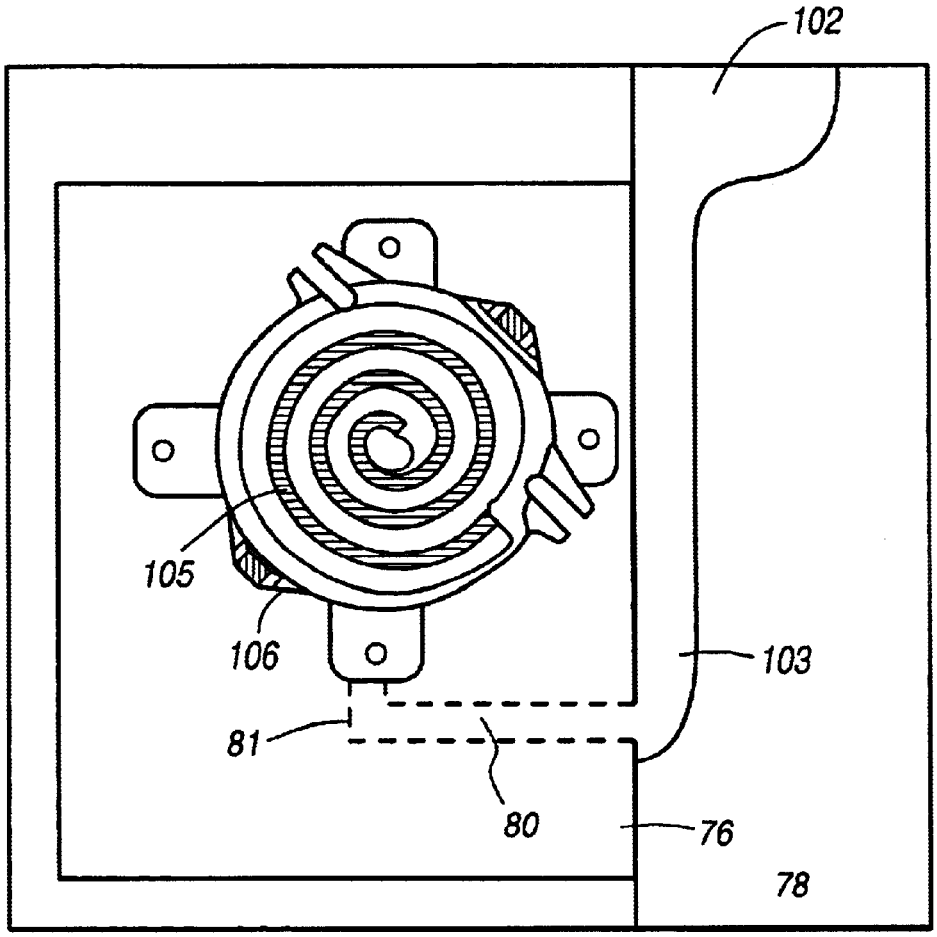

FIGS. 7 and 8 depict an alternate embodiment of the current invention. FIG. 7 shows a side view of the alternate completed mold 100 of the current invention. As shown in FIG. 7, the pouring basin 102 and sprue 103 are incorporated onto the parting line surface 104 of the second side mold 105 of the alternate mold 100. The first side mold 106 of the alternate mold 100, as shown, merely acts as one of the surfaces of the pouring basin 102 and sprue 103 and to hold the core in place. As with the other completed mold 70 previously described, the gate 80 is incorporated into the core 76. Additionally, the backsplash of the gate system is incorporated into the core and may be a non-critical surface of the cast compound.

FIG. 8 depicts the second side mold 105 and shows a square core or core assembly 76 which incorporates the involute form of the scroll component 106, set into the green sand molding material 78. Formed within the green sand molding material 78 of the first side mold is the pouring basin 102 and the sprue 103 communicating with the gate 80 defined within the core 76. The backsplash 81 allows the molten material to change directions and flow into the cavity 79 for the cast material. Shown is a scroll component 106 cast into the cavity 79 formed between the core 76 and the green sand molding material 78 on the second side mold 105. It is envisioned that a fusible plug 84 either in a flat format or in the shape of a cup 86 can be incorporated into the gating system (runner or gate) 80 of the mold 100. Additionally, the filter element 92 can also be incorporated into the gate 80 in the core 76.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for casting a structure comprising:

a vertically parted sand mold assembly having a first side pattern defining a first impression and a second side pattern defining a second impression, at least one of said side patterns defining a molten metal pouring basin cavity communicating with a sprue, and at least one of said side patterns having a core, the core defining an imprint surface and said core defines an aperture that is configured to function as a gate which fluidly couples the pouring basin cavity to a separate casting cavity formed by the first and second impressions, said core further defining a backsplash.

2. The apparatus of claim 1 wherein the gate is a notch gate.

3. The apparatus of claim 1 wherein the core defines a J-shaped fluid trap.

4. The apparatus of claim 1 wherein the first side pattern contains no feature of the cast part.

5. The apparatus of claim 1 wherein a core is a resin bonded shell.

6. The apparatus of claim 1 wherein the gate contains a fusible plug.

7. The apparatus of claim 6 wherein the fusible plug is a steel disk.

8. The apparatus of claim 6 wherein the fusible plug is cup shaped.

9. The apparatus of claim 8 wherein the fusible plug has retention ears for coupling to the core.

10. The apparatus of claim 1 wherein the gate contains a filter element.

11. The apparatus of claim 10 wherein the filter element is a ceramic filter inserted within the gate.

12. The apparatus of claim 10 wherein the filter element is a ceramic.

13. The apparatus of claim 10 wherein the filter further comprises a fusible plug.

14. The apparatus of claim 13 wherein the fusible plug is a steel disk.

15. The apparatus of claim 13 wherein the fusible plug is coupled to the core.

16. The apparatus of claim 13 wherein the fusible plug is cup shaped.

17. The apparatus of claim 16 wherein the fusible plug has ears coupled to the core.

18. The apparatus of claim 16 wherein the fusible plug is bonded to the core with an adhesive.

19. The apparatus of claim 16 wherein the fusible plug contains an inoculant.

20. The apparatus of claim 16 wherein the fusible plug assists in the formation of compacted graphite.

21. The apparatus of claim 10 wherein the gate is a hole disposed through the core element.

22. An apparatus for casting a scroll component comprising:

a vertically parted sand mold assembly having a first side pattern defining a first impression and a second side pattern defining a second impression, at least one of said side patterns defining a molten metal pouring basin cavity communicating with a sprue, and at least one of said side patterns having a core, the core defining an involute imprint surface and the core defines an aperture that is configured to function as a gate, the aperture fluidly couples the pouring basin cavity to a separate casting cavity formed by the first and second impressions, wherein the aperture is defined between the pouring basin cavity and the separate casting cavity.

23. The apparatus of claim 22 wherein the core defines a J-shaped fluid trap.

24. The apparatus of claim 22 wherein the first side pattern contains no feature of the cast part.

25. The apparatus of claim 22 wherein a core is a resin bonded shell.

26. The apparatus of claim 22 wherein the gate contains a fusible plug.

27. The apparatus of claim 26 wherein the fusible plug is a steel disk.

28. The apparatus of claim 22 wherein the fusible plug is cup shaped.

29. The apparatus of claim 22 wherein the fusible plug contains an inoculant.

30. The apparatus of claim 22 wherein the sprue and pouring basin cavity are formed in the second side pattern.

31. The apparatus of claim 22 wherein the sprue and the pouring basin are formed in the first side pattern.

32. A method of casting a scroll component comprising the steps of:

providing a mold having a vertical parting line and a first and second side mold, at least one of said side molds defining a molten metal pouring basin cavity communicating with a sprue, the second side mold having a core, the core has an imprint surface and the core defines an aperture therethrough which fluidly couples the pouring basin cavity to a separate casting cavity defined by the mold, the core further defining a back splash;

providing a fusible plug in the aperture; and providing molten metal into the pouring basin.

33. The method of claim 32 wherein providing a fusible plug in the aperture, includes providing a fusible plug in the aperture which reduces the velocity of the molten metal entering the aperture.

34. The method of claim 32 wherein providing a fusible plug in the aperture, includes providing an inoculant.

35. The method of claim 34 wherein providing a mold includes providing a riser neck and providing a fusible plug is providing a fusible plug in said riser neck.

36. The method of claim 34 wherein providing a mold includes providing a riser neck and providing a fusible plug is providing a fusible plug in said riser neck.

* * * * *

UNITED STATES PATENT AND TRADEMARK OFFICE

CERTIFICATE OF CORRECTION

PATENT NO. : 6,860,315 B2
DATED : March 1, 2005
INVENTOR(S) : Warren G. Williamson It is certified that error appears in the above-identified patent and that said Letters Patent is hereby corrected as shown below:

Column 4,
Line 50, after "influx" insert -- of --.
Line 54, after "incorporated" insert -- in --.

Column 8,
Lines 30-32, delete "36. The method of claim 34 wherein providing a mold includes providing a riser neck and providing a fusible plug is providing a fusible plug in said riser neck.".

Signed and Sealed this

Fourth Day of October, 2005

JON W. DUDAS
*Director of the United States Patent and Trademark Office*